US006269893B1

(12) United States Patent
Beaton et al.

(10) Patent No.: US 6,269,893 B1
(45) Date of Patent: Aug. 7, 2001

(54) BI-CENTERED DRILL BIT HAVING IMPROVED DRILLING STABILITY MUD HYDRAULICS AND RESISTANCE TO CUTTER DAMAGE

(75) Inventors: Timothy P. Beaton, The Woodlands; David Truax, Houston, both of TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/345,688

(22) Filed: Jun. 30, 1999

(51) Int. Cl.[7] ..... E21B 10/40
(52) U.S. Cl. ..... 175/391; 175/399
(58) Field of Search ..... 175/391, 399, 175/385, 408

(56) References Cited

U.S. PATENT DOCUMENTS

| | | | |
|---|---|---|---|
| 3,851,719 | 12/1974 | Thompson et al. | 175/406 |
| 4,440,244 | 4/1984 | Wiredal | 175/292 |
| 4,690,229 | 9/1987 | Raney | 175/325 |
| 4,815,342 | 3/1989 | Brett et al. | 76/108.1 |
| 4,905,776 | 3/1990 | Beynet et al. | 175/56 |
| 4,932,484 | 6/1990 | Warren et al. | 175/329 |
| 5,010,789 | 4/1991 | Brett et al. | 76/108.2 |
| 5,042,621 | 8/1991 | Ovaska et al. | 187/133 |

(List continued on next page.)

FOREIGN PATENT DOCUMENTS

| | | |
|---|---|---|
| 0 58 061 A2 | 8/1982 | (EP) . |
| 1 039 095 A2 | 9/2000 | (EP) . |
| 2648862 | 12/1990 | (FR) . |
| 2 197 676 | 5/1988 | (GB) . |
| 2 328 698 | 3/1999 | (GB) . |
| 2 329 203 | 3/1999 | (GB) . |
| 2 330 599 | 4/1999 | (GB) . |

OTHER PUBLICATIONS

T,M. Warren et al., "Drag Bit Performance Modeling", Society of Petroleum Engineers, SPE 15618, 1986.

T.M. Warren et al., "Laboratory Drilling Performance of PDC Bits", Society of Petroleum Engineers, SPE 15617, 1986.

(List continued on next page.)

*Primary Examiner*—William Neuder
(74) *Attorney, Agent, or Firm*—Rosenthal & Osha L.L.P.

(57) ABSTRACT

A bi-center drill bit includes pilot and reaming blades affixed to a body at azimuthally spaced locations. The blades have PDC cutters attached at selected positions. In one aspect, the pilot blades form a section having length along the bit axis less than about 80 percent of a diameter of the section. In another aspect, selected pilot blades and corresponding reaming blades are formed into single spiral structures. In another aspect, shapes and positions of the blades and inserts are selected so that lateral forces exerted by the reaming and the pilot sections are balanced as a single structure. Lateral forces are preferably balanced to within 10 percent of the total axial force on the bit. In another aspect, the center of mass of the bit is located less than about 2.5 percent of the diameter of the bit from the axis of rotation. In another aspect, jets are disposed in the reaming section oriented so that their axes are within about 30 degrees of normal to the axis of the bit. In another aspect, the reaming blades are shaped to conform to the radially least extensive, from the longitudinal axis, of a pass-through circle or a drill circle, so the cutters on the reaming blades drill at the drill diameter, without contact to the cutters on the reaming blades when the bit passes through an opening having about the pass-through diameter.

119 Claims, 7 Drawing Sheets

U.S. PATENT DOCUMENTS

| | | | |
|---|---|---|---|
| 5,052,503 | 10/1991 | Lof | 175/258 |
| 5,099,929 | 3/1992 | Keith et al. | 175/61 |
| 5,111,892 | 5/1992 | Sinor et al. | 175/65 |
| 5,131,478 | 7/1992 | Brett et al. | 175/57 |
| 5,178,222 | 1/1993 | Jones et al. | 175/398 |
| 5,186,268 | 2/1993 | Clegg | 175/399 |
| 5,377,773 | 1/1995 | Tibbitts | 175/397 |
| 5,402,856 | 4/1995 | Warren et al. | 175/57 |
| 5,423,389 | 6/1995 | Warren et al. | 175/75 |
| 5,497,842 | 3/1996 | Patusek et al. | 175/334 |
| 5,678,644 | 10/1997 | Fielder | 175/391 |
| 5,957,223 | 9/1999 | Doster et al. | 175/57 |
| 5,992,548 * | 11/1999 | Silva et al. | 175/391 |
| 6,039,131 * | 3/2000 | Beaton | 175/376 |

OTHER PUBLICATIONS

Diamond Products International brochure entitled, "The Latest Generation of Bi–Center Bits" for the Speed Reamer, undated.

Diamond Products International Product Bulletin entitled, "DPI Shaped Cutters and Reverse Bullets", dated Nov. 9, 1995.

European Search Report dated Jan. 27, 2001, 8 pages.

* cited by examiner

BI-CENTERED DRILL BIT HAVING IMPROVED DRILLING STABILITY MUD HYDRAULICS AND RESISTANCE TO CUTTER DAMAGE

BACKGROUND OF THE INVENTION

1. Field of the Invention

This invention relates generally to the field of polycrystalline diamond compact (PDC) drilling bits. More specifically, this invention relates to PDC bits which drill a hole through earth formations where the drilled hole has a larger diameter than the "pass-through " diameter of the drill bit.

2. Description of the Related Art

Drill bits which drill holes through earth formations where the hole has a larger diameter than the bit's pass-through diameter (the diameter of an opening through which the bit can freely pass) are known in the art. Early types of such bits included so-called "underreamers ", which were essentially a drill bit having an axially elongated body and extensible arms on the side of the body which reamed the wall of the hole after cutters on the end of the bit had drilled the earth formations. Mechanical difficulties with the extensible arms limited the usefulness of underreamers.

More recently, so-called "bi-centered " drill bits have been developed. A typical bi-centered drill bit includes a "pilot " section located at the end of the bit, and a "reaming" section which is typically located at some axial distance from the end of the bit (and consequently from the pilot section). One such bi-centered bit is described in U.S. Pat. No. 5,678,644 issued to Fielder, for example. Bi-centered bits drill a hole larger than their pass through diameters because the axis of rotation of the bit is displaced from the geometric center of the bit. This arrangement enables the reaming section to cut the wall of the hole at a greater radial distance from the rotational axis than is the radial distance of the reaming section from the geometric center of the bit. The pilot section of the typical bi-centered bit includes a number of PDC cutters attached to structures ("blades ") formed into or attached to the end of the bit. The reaming section is, as already explained, typically spaced axially away from the end of the bit, and is also located to one side of the bit. The reaming section also typically includes a number of PDC inserts on blades on the side of the bit body in the reaming section.

Limitations of the bi-centered bits known in the art include the pilot section being axially spaced apart from the reaming section by a substantial length. FIG. 1 shows a side view of one type of bi-center bit known in the art, which illustrates this aspect of prior art bi-center bits. The bi-center bit 101 includes a pilot section 106, which includes pilot blades 103 having PDC inserts 110 disposed thereon, and includes gauge pads 112 at the ends of the pilot blades 103 axially distant from the end of the bit 101. A reaming section 107 can include reaming blades 111 having PDC inserts 105 thereon and gauge pads 117 similar to those on the pilot section 106. In the bi-center bit 101 known in the art, the pilot section 106 and reaming section are typically separated by a substantial axial distance, which can include a spacer or the like such as shown at 102. Spacer 102 can be a separate element or an integral part of the bit structure but is referred to here as a "spacer " for convenience. As is conventional for drill bits, the bi-center bit 101 can include a threaded connector 104 machined into its body 114. The body 114 can include wrench flats 115 or the like for make up to a rotary power source such as a drill pipe or hydraulic motor.

An end view of the bit 101 in FIG. 1 is shown in FIG. 2. The blades 108A in the pilot section and the blades 111B in the reaming section are typically straight, meaning that the cutters 110 are disposed at substantially the same relative azimuthal position on each blade 108A, 111B. In some cases the blades 108A in the pilot section 106 may be disposed along the same azimuthal direction as the blades 111B in the reaming section 110.

Prior art bi-center bits are typically "force-balanced "; that is, the lateral force exerted by the reaming section 110 during drilling is balanced by a designed-in lateral counterforce exerted by the pilot section 106 while drilling is underway. However, the substantial axial separation between the pilot section 106 and the reaming section 110 results in a turning moment against the axis of rotation of the bit, because the force exerted by the reaming section 110 is only balanced by the counterforce (exerted by pilot section 106) at a different axial position. This turning moment can, among other things, make it difficult to control the drilling direction of the hole through the earth formations.

Still another limitation of prior art bi-centered bits is that the force balance is calculated by determining the net vector sum of forces on the reaming section 110, and designing the counterforce at the pilot section 106 to offset the net vector force on the reaming section without regard to the components of the net vector force originating from the individual PDC inserts. Some bi-center bits designed according to methods known in the art can have unforeseen large lateral forces, reducing directional control and drilling stability.

SUMMARY OF THE INVENTION

One aspect of the invention is a bi-center drill bit which includes a body having pilot blades and reaming blades affixed to the body at azimuthally spaced apart locations. The pilot blades and the reaming blades have a plurality of polycrystalline diamond compact (PDC) cutters attached to them at selected positions along each of the blades. In one example of the invention, the pilot blades form a pilot section having a length along an axis of the bit which is less than about 80 percent of a diameter of a pilot section of the bit. In one example of this aspect of the invention, the total make-up length of the bit, including the length of the pilot section and a reaming section formed from the reaming blades is less than about 133 percent of the drill diameter of the bit.

In another aspect of the invention, selected ones of the pilot blades and reaming blades on a bi-center bit are formed into corresponding single (unitary) spiral structures to improve drilling stability of the bit. Selected ones of the reaming blade and pilot blades can be formed as spirals, where the azimuthal position of the cutters on each such spiral blade is different from that of the other cutters on that blade.

In another aspect of the invention, the shapes and positions of the blades, and the positions of the PDC cutters thereon of a bi-center bit are selected so that the lateral forces exerted by the reaming section of the bit and by the pilot section of the bit are balanced as a single structure, whereby the forces exerted by each of the PDC inserts are summed without regard to whether they are located on the reaming section or on the pilot section. These forces are in one example preferably balanced to within 10 percent of the total axial force exerted on the bit.

In another aspect of the invention, the center of mass of the a bi-center drill bit is located less than about 2.5 percent of the drilled diameter of the bit away from the axis of rotation (longitudinal axis) of the drill bit.

In another aspect of the invention, a bi-center drill bit includes drilling fluid discharge orifices ("jets") in the reaming section of the bit which are oriented so that their axes are within about 30 degrees of normal to the axis of the bit.

In another aspect of the invention, a bi-center bit includes reaming blades which are shaped to conform to whichever is radially least extensive, with respect to the longitudinal axis of the bit, at the azimuthal position of the particular blade, either a pass through circle or a drill circle. The drill circle and the longitudinal axis are substantially coaxial. The axis of the pass-through circle is offset from the longitudinal axis and defines an arcuate section wherein the pass-through circle extends laterally from the longitudinal axis past the drill circle. The leading edge cutters on the reaming blades are, as a result of this selected shape of the reaming blades, located radially inward of the trailing edge of the reaming blades with respect to the pass through circle where the reaming blades conform to the drill circle (in the arcuate section). This provides that the drill bit can pass through an opening having a diameter of about the pass-through diameter, for example casing in a wellbore, but can also drill out casing cementing equipment in a wellbore without sustaining damage to the leading edge cutters on the reaming blades.

Another aspect of the invention is a bi-center drill bit comprising a body having pilot blades and reaming blades affixed to the body at azimuthally spaced apart locations. The pilot blades and reaming blades having polycrystalline diamond compact (PDC) cutters attached to them at selected positions along each of the blades. The pilot blades have additional cutters attached to them at locations which are proximate to a circle defined by precessing the pass-through axis of the bit about the longitudinal axis of the bit. In one example, the additional cutters are tungsten carbide cutters, PDC cutters or diamond cutters. In one example, the side rake or the back rake angle of the cutters proximate to the circle is changed. In another example, additional cutters can be provided proximate to the circle by adding a row of cutters on thickened blade portions proximate to the circle Another aspect of the invention is a method for drilling out a casing having float equipment therein. The method includes rotating in the casing a bi-center drill bit having pilot blade and reaming blades thereon at azimuthally spaced apart locations. The blades have PDC cutters thereon. The reaming blades are shaped to conform to whichever is radially least extensive, with respect to the longitudinal axis of the bit, at the azimuthal position of the particular blade, either a pass through circle or a drill circle. The drill circle and the longitudinal axis are substantially coaxial. The axis of the pass-through circle is offset from the longitudinal axis and defines an arcuate section wherein the pass-through circle extends laterally from the longitudinal axis past the drill circle. The leading edge cutters on the reaming blades are, as a result of this selected shape of the reaming blades, located radially inward of the trailing edge of the reaming blades with respect to the pass through circle where the reaming blades conform to the drill circle (in the arcuate section). This provides that the drill bit can pass through the casing, which has a diameter of about the pass-through diameter, without damaging the inserts on the reaming blades. When the bit fully penetrates the float equipment and exits the casing, the bit is then rotated about the longitudinal axis and then drills a hole, in the earth formations beyond the casing, which has the drill diameter.

DESCRIPTION OF PREFERRED EMBODIMENTS

Figure 1:
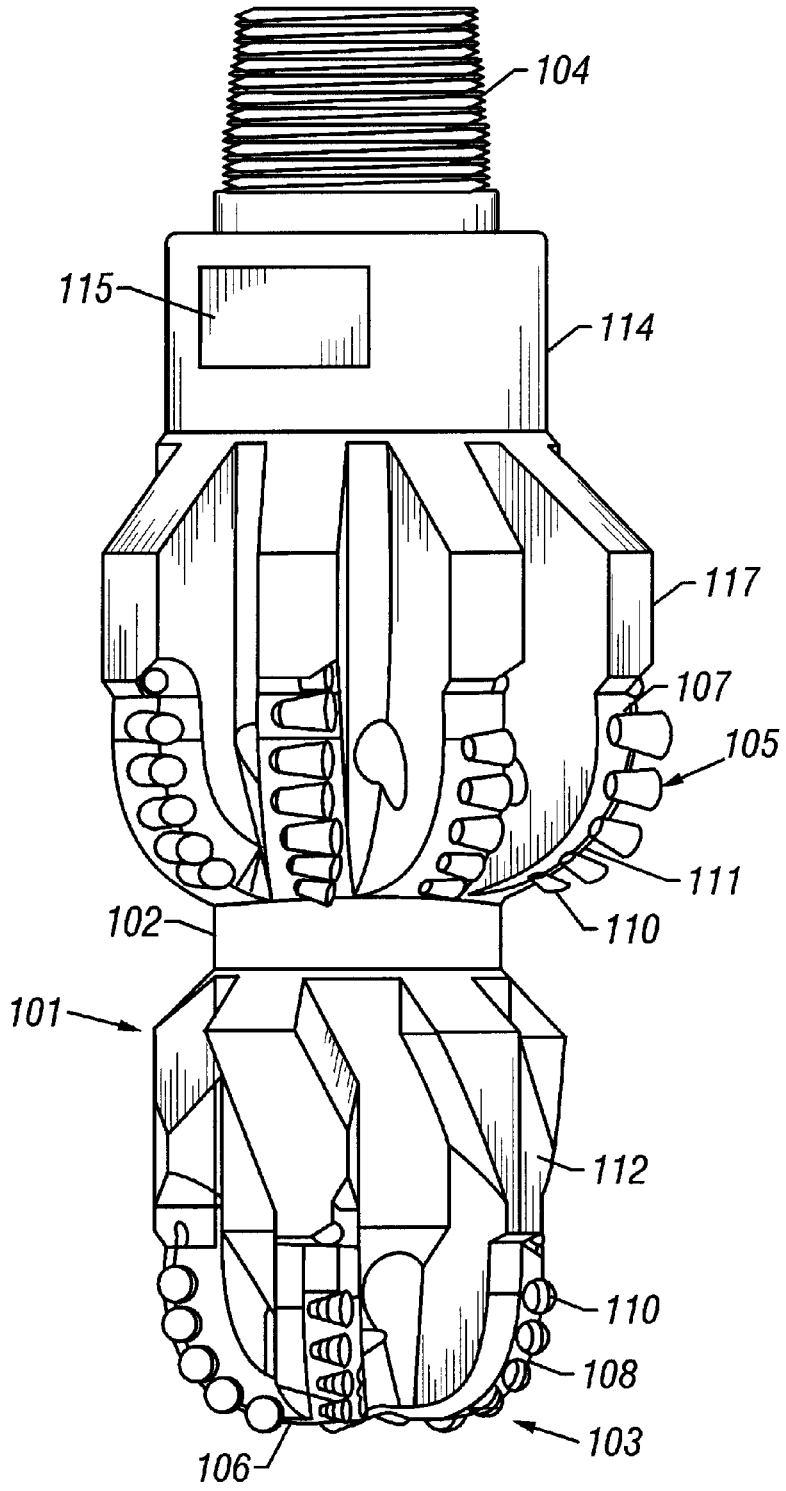
FIG. 1 (Prior Art)
FIG. 1 shows a side view of a prior art bi-center drill bit.
Figure 2:
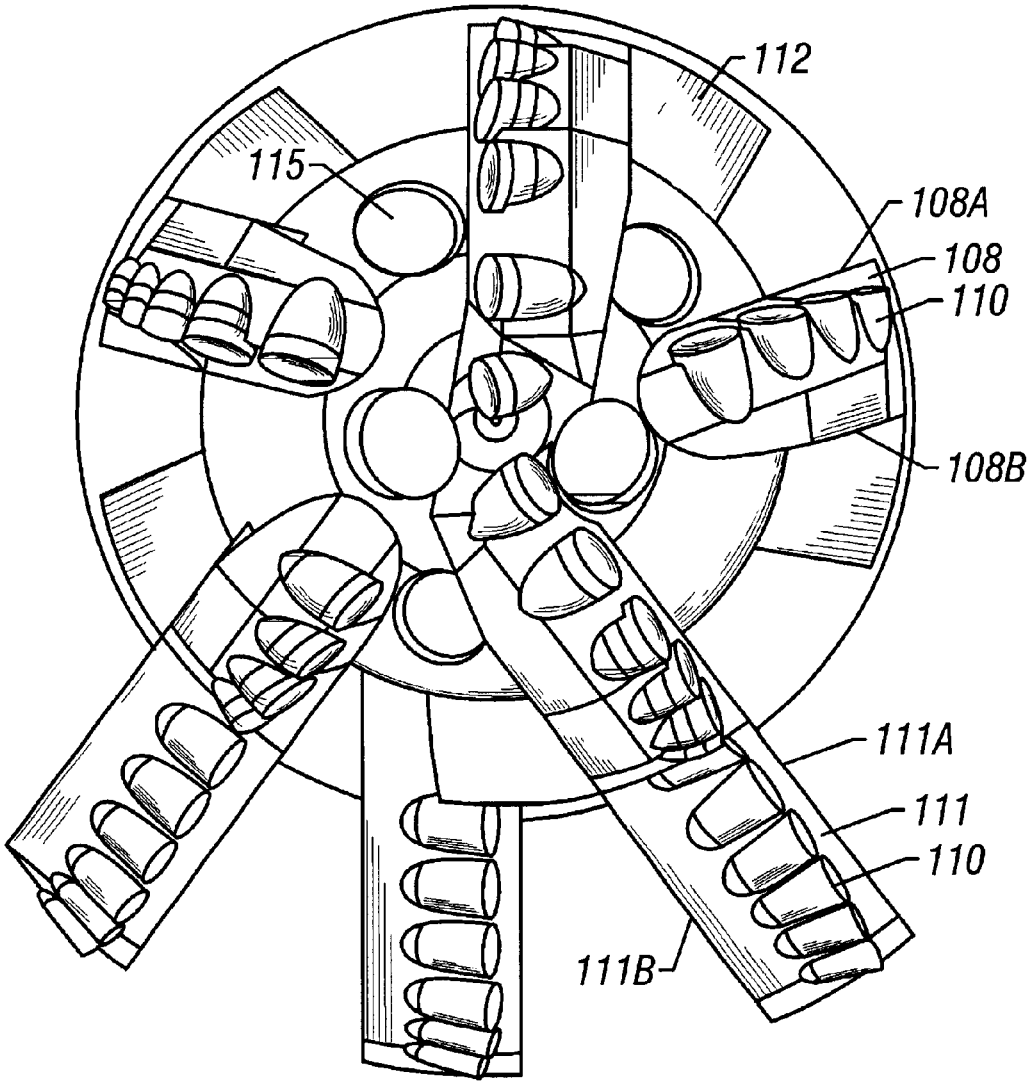
FIG. 2 (Prior Art)
FIG. 2 shows an end view of a prior art bi-center drill bit.
Figure 3:
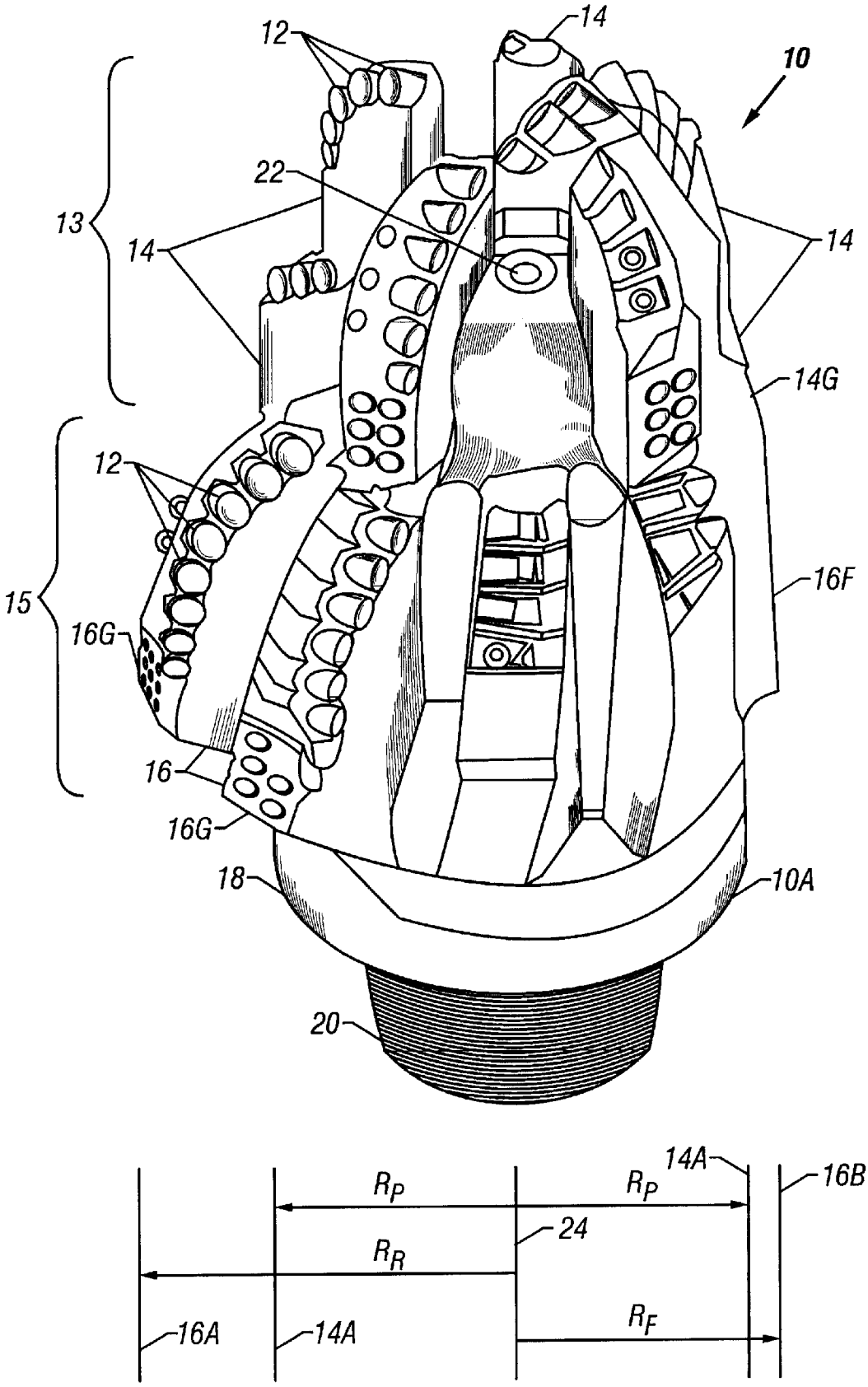
FIG. 3 shows an oblique view of one embodiment of the drill bit of the invention.

An example of a drill bit incorporating several aspects of the invention is shown in oblique view in FIG. 3. A bi-center drill bit 10 includes a body 18 which can be made from steel or other material conventionally used for drill bit bodies. One end of the body 18 can include thereon a threaded connection 20 for attaching the bit 10 to a source of rotary power, such as a rotary drilling rig (not shown) or hydraulic motor (not shown) so that the bit 10 can be turned to drill earth formations (not shown).

At the end of the body 18 opposite the threaded connection 20 is a pilot section 13 of the bit 10. The pilot section 13 can include a set of azimuthally spaced apart blades 14 affixed to or otherwise formed into the body 18. On each of the blades 14 is mounted a plurality of polycrystalline diamond compact (PDC) inserts, called cutters, such as shown at 12. The pilot blades 14 typically each extend laterally from the longitudinal axis 24 of the bit 10 by the same amount. The pilot section 13 thus has a drilling radius, which can be represented by $R_P$ (14A in FIG. 3) of about the lateral extent of the pilot blades 14. The radially outermost surfaces of the pilot blades 14 generally conform to a circle which is substantially coaxial with the longitudinal axis 24 of the bit 10. When the bit 10 is rotated about its longitudinal axis 24, the pilot section 13 will thus drill a hole having a diameter about equal to $2\times R_P$. The pilot hole diameter can be maintained by gauge pads such as shown in FIG. 3 at 14G, disposed on the radially (laterally) outermost portion of the pilot blades 14.

A reaming section 15A is positioned on the body 18 axially spaced apart from the pilot section 13. The reaming section 15 can also include a plurality of blades 16 each having thereon a plurality of PDC cutters 12. The reaming blades 16 can be affixed to or formed into the body 18 just as the pilot blades 14. It should be understood that the axial spacing referred to between the pilot section 13 and the reaming section 15 denotes the space between the axial positions along the bit 10 at which actual cutting of earth formations by the bit 10 takes place. It should not be inferred that the pilot section 13 and reaming section 15 are physically separated structures, for as will be further explained, one advantageous aspect of the invention is a unitized spiral structure used for selected ones of the blades 14, 16. Some of the blades 16 in the reaming section 15 extend a maximum lateral distance from the rotational axis 24 of the bit 10 which can be represented by $R_R$ (16A in FIG. 3), and which is larger than $R_P$.

The bit 10 shown in FIG. 3 has a "pass-through" diameter (the diameter of an opening through which the bit 10 will fit), which as will be further explained, results from forming the reaming blades 16 to conform to a circle having the pass-through diameter. The center of the pass through circle, however, is offset from the longitudinal axis 24 of the bit. As a result of forming the blades 16 to conform to the axially offset pass-through circle, some of the reaming blades 16, such as shown at 16F in FIG. 3 will not extend laterally from the axis 24 as much as the other reaming blades. The laterally most extensive ones of the reaming blades 16 thus formed can include gauge pads such as shown at 16G. During drilling, as the bit 10 is rotated about the longitudinal axis 24, the hole which is drilled by the reaming section 15 will have a diameter about equal to $2\times R_R$ as the blades 16 in the reaming section 15 which extend the full lateral distance $R_R$ from the longitudinal axis 24 rotate about the longitudinal axis 24.

The bit 10 includes a plurality of jets, shown for example at 22, the placement and orientation of which will be further explained.

In one aspect of the invention, it has been determined that a bi-center bit can effectively drill a hole having the expected drill diameter of about $2\times R_R$ even while the pilot section 13 axial length ($L_p$ in FIG. 5) is less than about 80 percent of the diameter of the pilot section ($2\times R_P$). The pilot section length ($L_p$ in FIG. 5) is defined herein as the length from the end of the bit 10 to top of the reaming section 15. In this example, the bit 10 also has an overall axial make-up length (measured from the end of the bit to a make up shoulder 10A) which is less than about 133 percent of the drilling diameter of the bit ($2\times R_R$). Prior art bi-center bits have pilot section axial lengths substantially more than the 80 percent length-to-diameter of the bit 10 of this invention. It has been determined that drilling stability of a bi-center bit is not compromised by shortening the pilot section axial length and overall axial make-up length of the bit in accordance with the invention.

Conversely, it should be noted that the reaming section 15 necessarily exerts some lateral force, since the blades 16 which actually come into contact the formation (not shown) during drilling are located primarily on one side of the bit 10. The lateral forces exerted by all the PDC cutters 12 are balanced in the bit of this invention in a novel manner which will be further explained. However, as a result of any form of lateral force balancing between the pilot section 13 and the reaming section 15, the pilot section 13 necessarily exerts, in the aggregate, a substantially equal and azimuthally opposite lateral force to balance the lateral force exerted by the reaming section 15. As will be appreciated by those skilled in the art, the axial separation to between the lateral forces exerted by the reaming section 15 and the pilot section 13 results in a turning moment being developed normal to the axis 24. The turning moment is proportional to the magnitude of the lateral forces exerted by the reaming section 15 and the pilot section 13, and is also proportional to the axial separation of the reaming section 15 and the pilot section 13. In this aspect of the invention, the axial separation of the pilot section 13 and the reaming section is kept to a minimum value by having a pilot section length 13 and overall length as described above. By keeping the axial separation to a minimum, the turning moment developed by the bit 10 is minimized, so that drilling stability can be improved.

In another aspect of the invention, it has been determined that the drilling stability of the bi-center bit 10 can be improved when compared to the stability of prior art bi-center bits by mass-balancing the bit 10. It has been determined that the drilling stability will improve a substantial amount when the bit 10 is balanced so its center of gravity is located within about 2.5 percent of the drill diameter of the bit ($2\times R_R$) from the axis of rotation 24. Prior art bi-center bits were typically not mass balanced at all. Mass balancing can be performed, among other ways, by locating the blades 14, 16 and selecting suitable sizes for the blades 14, 16, while taking account of the mass of the cutters 12, so as to provide the preferred mass balance. Alternatively, gauge pads, or other extra masses can be added as needed to achieve the preferred degree of mass balance. Even more preferable for improving the drilling performance of the bit 10 is mass balancing the bit 10 so that its center of gravity is within 1.5 percent of the drill diameter of the bit 10.

In another aspect of the invention, it has been determined that the drilling stability of a bi-center bit can be further improved by force balancing the entire bit 10 as a single structure. Force balancing is described, for example, in, T. M. Warren et al, *Drag Bit Performance Modeling*, paper no. 15617, Society of Petroleum Engineers, Richardson, Tex., 1986. Prior art bi-center bits were force balanced, but in a different way. In this embodiment of the invention the forces exerted by each PDC cutters 12 can be calculated individually, and the locations of the If blades and the PDC cutter 12 thereon can be selected so that the sum of all the forces exerted by each of the cutters 12 will have a net imbalance of less than about 10 percent of the total axial force exerted on the bit (known in the art as the "weight on bit"). The designs of both the pilot section 13 and the reaming section 15 are optimized simultaneously in this aspect of the invention to result in the preferred force balance. An improvement to drilling stability can result from force balancing according to this aspect of the invention because the directional components of the forces exerted by each individual cutter 12 are accounted for. In the prior art, some directional force components, which although summed to the net lateral force exerted individually by the reaming section and pilot section, can result in large unexpected side forces when the individual cutter forces are summed in the aggregate in one section of the bit to offset the aggregate force exerted by the other section of the bit. This aspect of the invention avoids this potential problem of large unexpected side forces by providing that the locations of and shapes of the blades 14, 1 and cutters 12 are such that the sum of the forces exerted by all of the PDC cutters 12, irrespective of whether they are in the pilot section 13 or in the reaming section 15, is less than about 10 percent of the weight on bit. It has been determined that still further improvement to the performance of the bit 10 can be obtained by balancing the forces to within 5 percent of the axial force on the bit 10.

Figure 4:
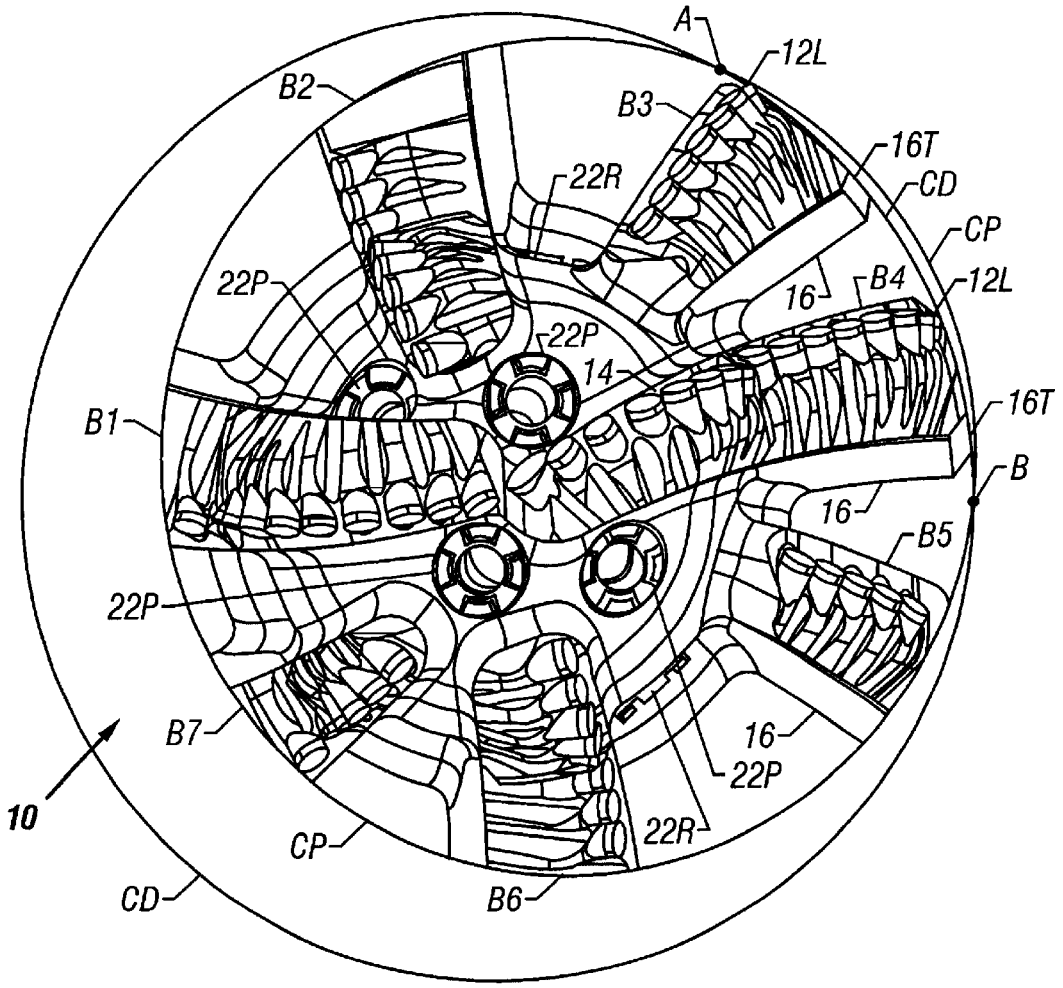
FIG. 4 shows an end view of one embodiment of the drill bit of the invention.

An end view of this embodiment of the invention is shown in FIG. 4 which illustrates several features intended to improve drilling stability of the bi-center bit 10. The blades 14 in the pilot section (13 in FIG. 3) are shown azimuthally spaced apart. Each pilot section blade 14 is preferably shaped substantially in the form of a spiral. The spiral need not conform to any specific spiral shape, but only requires that the blade be shaped so that the individual cutters (12 in FIG. 3) on each such spirally shaped blade are at different azimuthal positions with respect to each other. Although the example shown in FIG. 4 has every blade being spirally shaped, it is within the contemplation of this invention that only selected ones of the blades can be spiral shaped while the other blades may be straight. Each cutter on such straight blades may be at the same azimuthal position.

In another aspect of the invention, selected ones of the pilot blades 14 can be formed into the same individual spiral structure as a corresponding one of the reaming blades 16. This type of unitized spiral blade structure is used, for example, on the blades shown at B2, and B4 in FIG. 4. The reaming section 15 may include blades such as shown at B3, B5 and B6 in FIG. 4 which are not part of the same unitized spiral structure as a pilot blade 14, because there is no corresponding pilot blade 14 at same the azimuthal position as these particular reaming blades B3, B5, B6. It has been determined that having blades such as B2 and B4 shaped substantially as a unitized spiral structure, encompassing both the pilot blade 14 and the azimuthally corresponding reaming blade 16, improves the drilling stability of the bit 10 when compared to the stability of bi-center bits using straight-blades and/or non-unitized pilot/reaming blades as previously known in the art.

Figure 5:
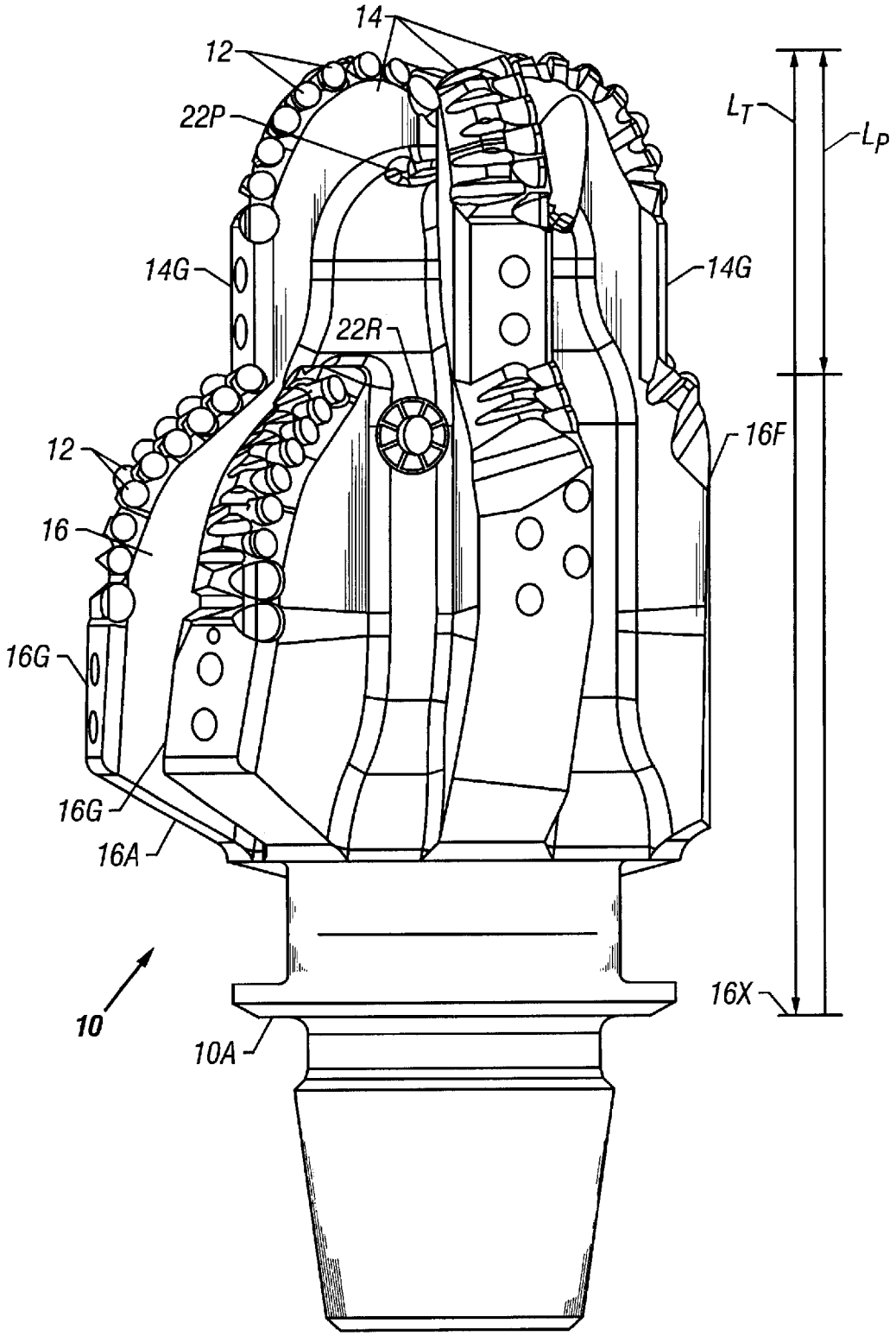
FIG. 5 shows a side view of one embodiment of the drill bit of the invention.

Shown in FIG. 5 are the previously referred to jets, in both the pilot section, shown at 22P, and in the reaming section, shown at 22R. In another aspect of this invention, it has been determined that cuttings (not shown) generated by the bit 10 as it penetrates rock formations (not shown) are more efficiently removed from the drilled hole, and hydraulic power used to pump drilling fluid (not shown) through the jets 22P, 22R is spent more efficiently, when the reaming jets 22R are oriented so that their axes are within about 30 degrees from a line normal to the axis (24 in FIG. 3) of the bit 10. Prior art bi-center bits typically include reaming jets which are oriented so that their axes are in approximately the same directions as the pilot jets, this being generally in the direction along which the bit drills. Other prior art bit have reaming jets which discharge directly opposite the direction of the bottom of the drilled hole. Either type of reaming jet previously known in the art has reduced hydraulic performance as compared to the bi-center bit of this aspect of the invention. It has been determined that the performance of the reaming jets 22R can be improved still further by orienting them so that their axes are within 20 degrees of a line normal to the longitudinal axis 24.

Another advantageous aspect of the invention is the shape of the reaming blades 16 and the positions of radially outermost cutters, such as shown at 12L, disposed on the reaming blades 16. In making the bit according to this aspect of the invention, the outer surfaces of the reaming blades 16 can first be cut or otherwise formed so as to conform to a circle having the previously mentioned drill diameter ($2\times R_R$). This so-called "drill circle " is shown in FIG. 4 at CD. The drill circle CD is substantially coaxial with the longitudinal axis (24 in FIG. 3) of the bit 10. In FIG. 4, the previously referred to pass-through circle is shown at CP. The outer surfaces of the reaming blades 16, after being formed to fit within the drill circle CD, can then be cut or otherwise formed to conform to the pass-through circle CP. The pass-through circle CP is axially offset from the drill circle CD (and the longitudinal axis 24) by an amount which results in some overlap between the circumferences of pass through circle CP and the drill circle CD.

The intersections of the pass-through circle CP and drill circle CD circumferences are shown at A and B in FIG. 4.

The radially outermost cutters 12L can then be positioned on the leading edge (the edge of the blade which faces the direction of rotation of the bit) of the radially most extensive reaming blades, such as shown at B3 and B4 in FIG. 4, so that the cutter locations will trace a circle having the full drill diameter ($2\times R_R$) when the bit rotates about the longitudinal axis 24. The radially most extensive reaming blades B3, B4, however, are positioned azimuthally between the intersections A, B of the drill circle CD and the pass through circle CP. The drill circle CD defines, with respect to the longitudinal axis 24, the radially outermost part of the bit at every azimuthal position. The reaming blades 16 are generally made to conform to the pass-through circle CP, however, the reaming blades B3, B4 located between intersections A and B will be formed to conform to the drill circle CD, because the drill circle CD therein defines the radially outermost extension of any part of the bit 10. Between intersections A and B, the drill circle CD is radially closer to the longitudinal axis 24 than is the pass-through circle CP, therefore the blades B3, B4 within the arcuate section between intersections A and B will extend only as far laterally as the radius of the drill circle CD. As shown in FIG. 4, the radially outermost cutters 12L on blades B3 and B4 can be positioned at "full gauge ", meaning that these cutters 12L are at the same radial distance from the axis 24 as the outermost parts of the blade B3, B4 onto which they are attached. However, the cutters 12L on blades B3, B4 are also disposed radially inward from the pass-through circle CP at the same azimuthal positions because of the limitation of the lateral extent of these blades B3, B4. Therefore, the outermost cutters 12L will not contact the inner surface of an opening having a diameter about equal to the pass-through diameter as the bit 10 is moved through such an opening. When rotated about the longitudinal axis 24, however, the bit 10 will drill a hole having the full drill diameter ($2\times R_R$). The preferred shape of the radially outermost reaming blades B3, B4 and the position of radially outermost cutters 12L thereon enables the bit 10 to pass freely through a protective casing (not shown) inserted into a wellbore, without sustaining damage to the outermost cutters 12L, while at the same time drilling a hole which has the full drill diameter ($2\times R_R$).

The reaming blades which do not extend to full drill diameter (referred to as "non-gauge reaming blades "), shown for example at B1, B2, B5, B6 and B7, have their outermost cutters positioned radially inward, with respect to pass-through circle CP, of the radially outermost portion of each such non-gauge reaming blade B1, B2, B5, B6 and B7 to avoid contact with any part of an opening at about the pass-through diameter. This configuration of blades and cutters has proven to be particularly useful in efficiently drilling through equipment (called "float equipment ") used to cement in place the previously referred to casing. By positioning the cutters 12 on the non-gauge reaming blades as described herein, damage to these cutters 12 can be avoided. Damage to the casing can be also be avoided by arranging the cutters 12 as described, particularly when drilling out the float equipment. Although the non-gauge reaming blades B1, B2, B5, B6 and B7 are described herein as being formed by causing these blades to conform to the pass-through circle CP, it should be understood that the pass-through circle only represents a radial extension limit for the non-gauge reaming blades B1, B2, B5, B6 and B7. It is possible to build the bit 10 with radially shorter non-gauge reaming blades. However, it should also be noted that by having several azimuthally spaced apart non-gauge reaming blade which conform to the pass-through circle CP, the likelihood is reduced that the outermost cutters 12L on the gauge reaming blades B3, B4 will contact any portion of an opening, such as a well casing, less than the drill diameter.

It should also be noted that the numbers of gauge and non-gauge reaming blades shown in FIG. 4 is only one example of numbers of gauge and non-gauge reaming blades. It is only required in this aspect of the invention that the gauge reaming blades conform to the drill circle CD, where the drill circle is less radially extensive than the pass-through circle CP to be able to locate the outermost cutters 12L at full gauge as in this aspect of the invention. It is also required that all the reaming blades conform to the radially least extensive of the drill circle CD and pass-through circle CP at any azimuthal blade position.

FIG. 5 shows a side view of this embodiment of the invention. As previously explained, the pilot section (13 in FIG. 3) can have an overall length, $L_P$, which is less than about 80 percent of the drill diameter of the pilot section (13 in FIG. 3). The overall make-up length, $L_T$, shown at 16X in FIG. 5, extending from the end of the bit to a make-up shoulder 10A, in this embodiment of the invention can be less than about 133 percent of the drill diameter of the bit 10. The gauge pads for the pilot section blades 14 are shown in FIG. 5 generally at 14G. The gauge pads for the reaming section blades 16 are shown generally at 16G.

Figure 6:
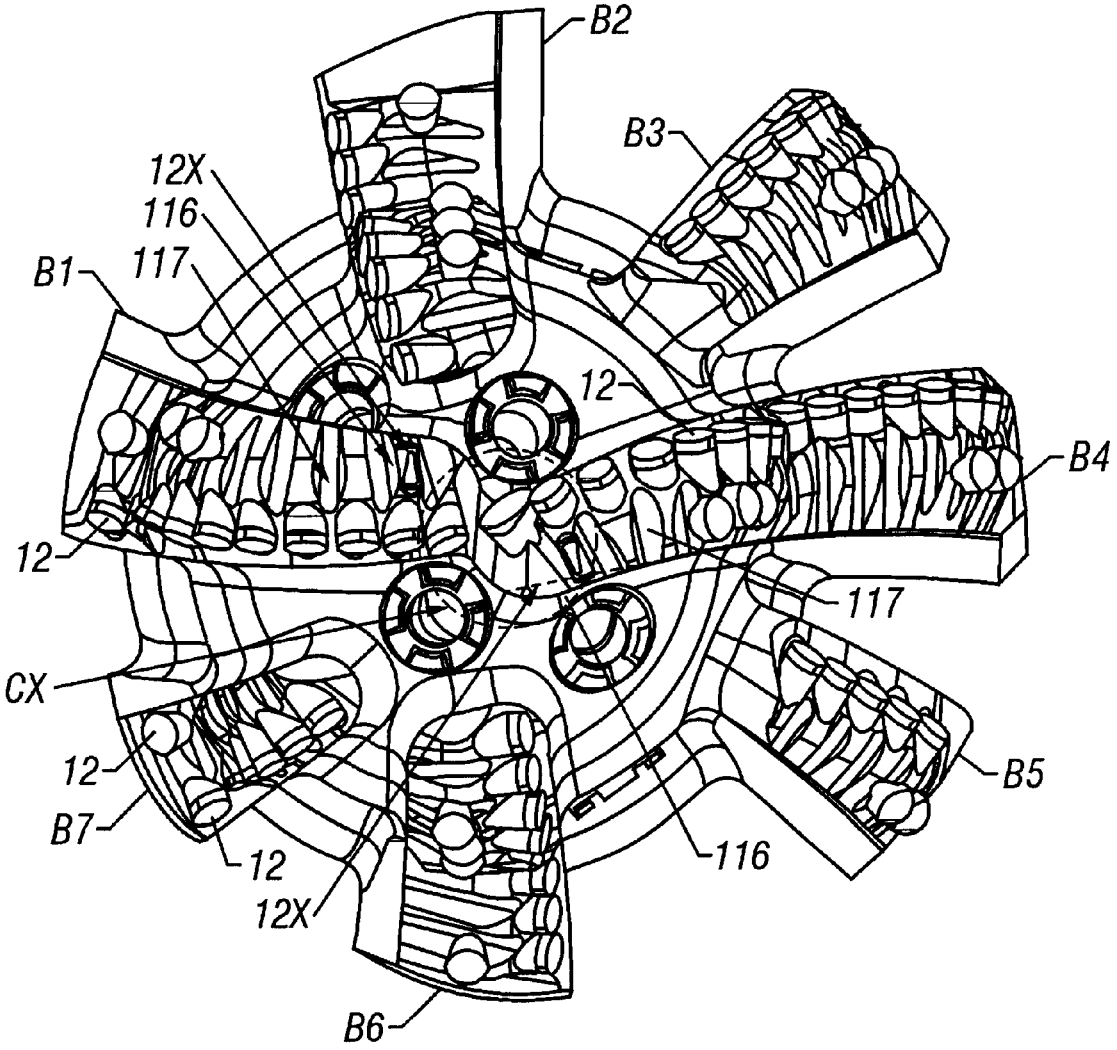
FIG. 6 shows an end view of one embodiment of the bit wherein additional cutters are attached to pilotblades near a precession circle.

A bi-center bit according to another aspect of this invention can be modified to improve its performance particularly where the bit is used to drill through the previously mentioned float equipment (this drilling operation referred to in the art as "drill out"). During such operations as drill out, a bi-center bit will rotate with a precessional motion which generally can be described as rotating substantially about the axis of the pass through circle, while the longitudinal axis go generally precesses about the axis of the pass through circle (CP in FIG. 4). This occurs because the bit is constrained during drill out to rotate within an opening (the interior of the casing) which is at, or only slightly larger than, the pass-through diameter of the bit. Referring to FIG. 6, the precessional motion of the longitudinal axis 24 about the pass-through circle axis defines a circle CX (hereinafter called a "precession circle") having a radius about equal to the offset between the longitudinal axis (24 in FIG. 3) and the axis of the pass through circle (CP in FIG. 4). The improvements to the drill bit in this aspect of the invention includes increasing the thickness of the blades, particularly in the vicinity of the precession circle CX. These thickened areas are shown at 116 on blades B1 and B4. As shown in FIG. 6, blades B1 and B4 can be the previously described unitized spiral structures forming both a reaming and pilot blade, although this is not to be construed as a limitation on the invention. The thickened blade areas 116 can be formed on any blade in the part of the blade proximate to the precession circle CX. The thickened blade areas 116 can be used to mount additional cutters, shown at 12X. The additional cutters 12X can be PDC inserts as are the other cutters 12, or can alternatively be tungsten carbide or other diamond cutters known in the art. Tungsten carbide cutters provide the advantage of relatively rapid wear down. The wear down, if it takes place during drill out, will leave the bi-center bit after drill out with a cutter configuration as shown in FIG. 4, (which excludes the additional cutters 12X) which configuration is well suited for drilling earth formations. In the vicinity of the precession circle CX the additional cutters 12X and the other cutters 12 can be mounted on the blades B1, B4 at a different back rake and/or side rake angle than are the cutters 12 away from the precession circle CX to reduce damage to the cutters 12, 12X during drill out.

Another aspect of the additional cutters 12X and the other cutters 12 proximate to the precession circle CX is that they can be mounted in specially formed pockets in the blade surface, such as shown at 117, which have greater surface area to contact the individual cutters 12, 12X than do the pockets which hold the other cutters 12 distal from the precession circle CX, so that incidence of the cutters 12, 12X proximate to the precession circle CX breaking off during drilling can be reduced, or even eliminated.

Figure 7:
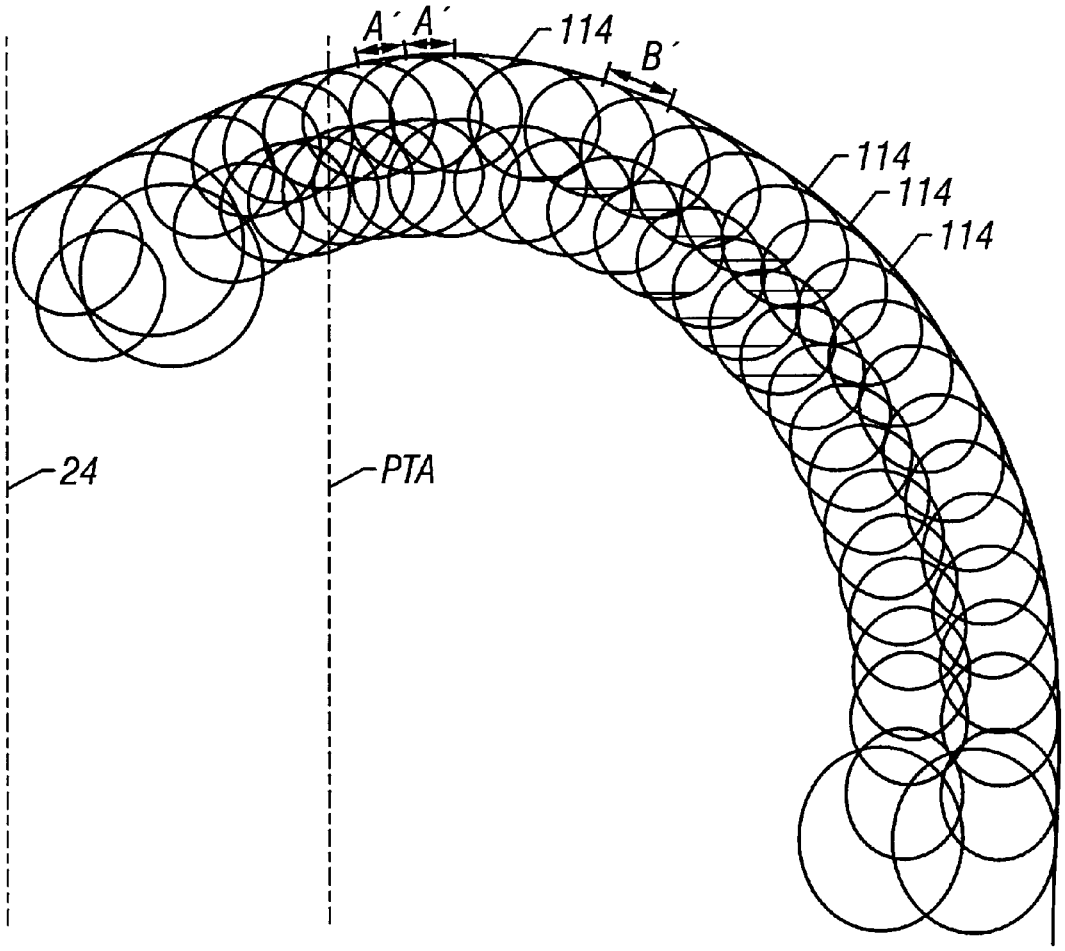
FIG. 7 shows a side view of locations of cutters on one of the blades in the embodiment of the bit shown in FIG. 6.

Referring to FIG. 7, another aspect of this invention is shown which can improve drilling performance of the bi-center bit, particularly during drill out. FIG. 7 shows a side profile view of the locations of cutters on the pilot blades (14 in FIG. 3). The positions of the ma cutters (12, 12X in FIG. 6) along the blade are shown by circles 114. In this aspect of the invention, the improvement is to include a greater volume of diamond per unit length of the blade in areas such as shown at A' in FIG. 7 than at other locations, such as at B', further away from the pass-through circle axis PTA. The increased diamond volume per unit blade length preferably is proximate to the pass-through circle axis PTA in FIG. 7.

The increased diamond volume can be provided by several different techniques. One such technique includes mounting additional cutters in a row of such additional cutters located azimuthally spaced apart from the other cutters on the same blade. This would be facilitated by including pockets therefor, such as at 117 in FIG. 6 in thickened areas on the blade (such as 116 in FIG. 6). Other ways to increase the diamond volume per unit length include increasing the number of cutters (12 in FIG. 6) per unit length along each blade. Still another way to increase the diamond volume would be to increase the thickness of the diamond "table " on the cutters proximate to the pass-through axis. Irrespective of how the diamond volume is increased, or irrespective of the ultimate cutter density selected near the pass-through axis PTA, the cutter forces and the mass of the bit are preferably balanced by the methods described earlier herein.

The bi-center drill bit described herein is particularly well suited for drill out of the float equipment used to cement a casing in a wellbore. To drill out using the bi-center bit of this invention, the bit is rotated within the casing while applying force along the longitudinal axis (24 in FIG. 3) to drill through the cement and float equipment at the bottom of the casing. While constrained within the casing (not shown), the reaming blades (16 in FIG. 3) are constrained to rotate substantially about the pass-through axis PTA because the reaming blades conform to the pass-through circle (CP in FIG. 4). The radially most extensive reaming blades do not contact the casing during drill out because they are located in the arcuate section where the drill circle (CD in FIG. 4) is radially less extensive than the pass through circle (CP in FIG. 4). As the float equipment is fully penetrated, and the bit leaves the casing, the bit will then rotate about the longitudinal axis (24 in FIG. 3) so that the hole drilled will have the full drill diameter.

It will be appreciated by those skilled in the art that other embodiments of this invention are possible which will not depart from the spirit of the invention as disclosed herein. Accordingly, the invention shall be limited in scope only by the attached claims.

What is claimed is:

1. A bi-center drill bit comprising:

a body having pilot blades and reaming blades affixed thereto at azimuthally spaced apart locations, said pilot blades and said reaming blades having polycrystalline diamond compact cutters attached thereto at selected positions along each of said blades, said pilot blades forming part of a pilot section having a length along a longitudinal axis of said bit less than about 80 percent of a diameter of said pilot section, a total make-up length along said longitudinal axis of said pilot section and a reaming section formed from said reaming blades is less than about 133 percent of a drilling diameter of said bit.

2. The bi-center bit as defined in claim 1 wherein selected azimuthally corresponding ones of said pilot blades and said reaming blades are formed into unitized spiral structures.

3. The bi-center bit as defined in claim 1 wherein said selected positions for said cutters are selected so that lateral forces exerted by said cutters disposed on said pilot blades and said reaming blades are balanced as a single structure.

4. The bi-center bit as defined in claim 3 wherein said lateral forces are balanced to less than about 10 percent of a total axial force exerted on said bit.

5. The bi-center bit as defined in claim 3 wherein said lateral forces are balanced to less than about 5 percent of a total axial force exerted on said bit.

6. The bi-center bit as defined in claim 1 wherein a radially outermost surface of each of said reaming blades extends at most to a radially least extensive one, with respect to said longitudinal axis, of a pass-through circle and a drill circle, said drill circle substantially coaxial with said longitudinal axis, said pass-through circle axially offset from said drill circle and defining an arcuate section wherein said pass-through circle extends laterally from said longitudinal axis past a radius of said drill circle, so that radially outermost cutters disposed on ones of said reaming blades disposed within said arcuate section drill a hole having a drill diameter substantially twice a maximum lateral extension of said reaming blades from said longitudinal axis while substantially avoiding wall contact along an opening having a diameter of said pass through circle.

7. The bi-center bit as defined in claim 1 wherein at least one jet disposed proximate to said reaming blades is oriented so that its axis subtends an angle of within approximately 30 degrees of a line normal to a longitudinal axis of said bit.

8. The bi-center bit as defined in claim 1 wherein at least one jet disposed proximate to said reaming blades is oriented so that its axis subtends an angle of within approximately 20 degrees of a line normal to a longitudinal axis of said bit.

9. The bi-center bit as defined in claim 1 wherein a center of mass of said bit is located within a distance of about 2.5 percent of a drill diameter of said bit from an axis of rotation of said bit.

10. The bi-center bit as defined in claim 1 wherein a center of mass of said bit is located within a distance of about 1.5 percent of a drill diameter of said bit from an axis of rotation of said bit.

11. A bi-center drill bit comprising:

a body having pilot blades and reaming blades affixed thereto at azimuthally spaced apart locations, said pilot blades and said reaming blades having polycrystalline diamond compact cutters attached thereto at selected positions along each of said blades, selected azimuthally corresponding ones of said pilot blades and said reaming blades formed into unitized spiral structures.

12. The bi-center drill bit as defined in claim 11 wherein said pilot blades form a pilot section having a length along a longitudinal axis of said bit less than about 80 percent of a diameter of said pilot section.

13. The bi-center but as defined in claim 12 wherein a total make-up length along said longitudinal axis of said pilot section and a reaming section formed from said reaming blades is less than about 133 percent of a drilling diameter of said bit.

14. The bi-center bit as defined in claim 11 wherein said selected positions for said cutters are selected so that lateral forces exerted by said inserts disposed on said pilot blades and said reaming blades are balanced as a single structure.

15. The bi-center bit as defined in claim 14 wherein said lateral forces are balanced to less than about 10 percent of a total axial force exerted on said bit.

16. The bi-center bit as defined in claim 14 wherein said lateral forces are balanced to less than about 5 percent of a total axial force exerted on said bit.

17. The bi-center bit as defined in claim 11 wherein a radially outermost surface of each of said reaming blades extends at most to a radially least extensive one with respect to said longitudinal axis of a pass through circle and a drill circle, said drill circle substantially coaxial with said longitudinal axis, said pass-through circle axially offset from said drill circle and defining an arcuate section extending laterally from said longitudinal axis past a radius of said drill circle within said arcuate section, so that radially outermost cutters disposed on ones of said reaming blades disposed within said arcuate section drill a hole having a drill diameter substantially twice a maximum lateral extension of said reaming blades from said longitudinal axis while substantially avoiding wall contact along an opening having a diameter of said pass through circle.

18. The bi-center bit as defined in claim 11 wherein a center of mass of said bit is located within a distance of about 2.5 percent of a drill diameter of said bit from an axis of rotation of said bit.

19. The bi-center bit as defined in claim 11 wherein a center of mass of said bit is located within a distance of about 1.5 percent of a drill diameter of said bit from an axis of rotation of said bit.

20. The bi-center bit as defined in claim 11 wherein at least one jet disposed proximate to said reaming blades is oriented so that its axis subtends an angle of within approximately 30 degrees of a line normal to a longitudinal axis of said bit.

21. The bi-center bit as defined in claim 11 wherein at least one jet disposed proximate to said reaming blades is oriented so that its axis subtends an angle of within approximately 20 degrees of a line normal to a longitudinal axis of said bit.

22. A bi-center drill bit comprising:

a body having pilot blades and reaming blades affixed thereto at azimuthally spaced apart locations around a circumference thereof, said pilot blades and said reaming blades having polycrystalline diamond compact cutters attached thereto at selected positions along each of said blades, said selected positions for said cutters arranged so that lateral forces exerted by said cutters disposed on said pilot blades and said reaming blades are balanced as a single structure.

23. The bi-center bit as defined in claim 22 wherein said pilot blades form part of a pilot section having a length along a longitudinal axis of said bit less than about 80 percent of a diameter of said pilot section.

24. The bi-center bit as defined in claim 23 wherein a total make-up length along said longitudinal axis of said pilot section and a reaming section formed from said reaming blades is less than about 133 percent of a drilling diameter of said bit.

25. The bi-center bit as defined in claim 22 wherein selected azimuthally corresponding ones of said pilot blades and said reaming blades are formed into unitized spiral structures.

26. The bi-center bit as defined in claim 22 wherein a radially outermost surface of each of said reaming blades extends at most to a radially least extensive one with respect to said longitudinal axis of a pass through circle and a drill circle, said drill circle substantially coaxial with said longitudinal axis, said pass-through circle axially offset from said drill circle and defining an arcuate section wherein said pass through circle extends from said longitudinal axis past a radius of said drill circle, so that radially outermost cutters disposed on ones of said reaming blades disposed within said arcuate section drill a hole having a drill diameter substantially twice a maximum lateral extension of said reaming blades from said longitudinal axis while substantially avoiding wall contact along an opening having a diameter of said pass through circle.

27. The bi-center bit as defined in claim 22 wherein at least one jet disposed proximate to said reaming blades is oriented so that its axis subtends an angle of within approximately 30 degrees of a line normal to a longitudinal axis of said bit.

28. The bi-center bit as defined in claim 22 wherein at least one jet disposed proximate to said reaming blades is oriented so that its axis subtends an angle of within approximately 20 degrees of a line normal to a longitudinal axis of said bit.

29. The bi-center bit as defined in claim 22 wherein a center of mass of said bit is located within a distance of about 2.5 percent of a drill diameter of said bit from an axis of rotation of said bit.

30. The bi-center bit as defined in claim 22 wherein a center of mass of said bit is located within a distance of about 1.5 percent of a drill diameter of said bit from an axis of rotation of said bit.

31. The bi-center bit as defined in claim 22 wherein said lateral forces are balanced to less than about 10 percent of a total axial force exerted on said bit.

32. The bi-center bit as defined in claim 22 wherein said lateral forces are balanced to less than about 5 percent of a total axial force exerted on said bit.

33. A bi-center drill bit comprising:

a body having pilot blades and reaming blades affixed thereto at azimuthally spaced apart locations, said pilot blades and said reaming blades having polycrystalline diamond compact cutters attached thereto at selected positions along each of said blades; and at least one jet disposed proximate to said reaming blades oriented so that its axis subtends an angle of within approximately 30 degrees of a line normal to a longitudinal axis of said bit.

34. The bi-center bit as defined in claim 33 wherein said at least one jet disposed proximate to said reaming blades is oriented so that its axis subtends an angle of within approximately 20 degrees of a line normal to a longitudinal axis of said bit.

35. The bi-center drill bit as defined in claim 33 wherein said pilot blade form part of a pilot section having a length along a longitudinal axis of said bit less than about 80 percent of a diameter of said pilot section.

36. The bi-center bit as defined in claim 35 wherein a total make-up length along said longitudinal axis of said pilot section and a reaming section formed from said reaming blades is less than about 133 percent of a drilling diameter of said bit.

37. The bi-center bit as defined in claim 33 wherein selected azimuthally corresponding ones of said pilot blades and said reaming blades are formed into unitized spiral structures.

38. The bi-center bit as defined in claim 33 wherein said selected positions for said compact inserts are selected so that lateral forces exerted by said inserts disposed on said pilot blades and said reaming blades are balanced as a single structure.

39. The bi-center bit as defined in claim 38 wherein said lateral forces are balanced to less than about 10 percent of a total axial force exerted on said bit.

40. The bi-center bit as defined in claim 38 wherein said lateral forces are balanced to less than about 5 percent of a total axial force exerted on said bit.

41. The bi-center bit as defined in claim 33 wherein a radially outermost surface of each of said reaming blades extends at most to a radially least extensive one with respect to said longitudinal axis of a pass through circle and a drill circle, said drill circle substantially coaxial with said longitudinal axis, said pass-through circle axially offset from said drill circle and defining an arcuate section wherein said pass-through circle extends from said longitudinal axis past a radius of said drill circle, so that radially outermost cutters disposed on ones of said reaming blades disposed within said arcuate section drill a hole having a drill diameter substantially twice a maximum lateral extension of said reaming blades from said longitudinal axis while substantially avoiding wall contact along an opening having a diameter of said pass through circle.

42. The bi-center bit as defined in claim 33 wherein a center of mass of said bit is located within a distance of about 2.5 percent of a drill diameter of said bit from an axis of rotation of said bit.

43. The bi-center bit as defined in claim 33 wherein a center of mass of said bit is located within a distance of about 1.5 percent of a drill diameter of said bit from an axis of rotation of said bit.

44. A bi-center drill bit comprising:

a body having pilot blades and reaming blades affixed thereto at azimuthally spaced apart locations, said pilot blades and said reaming blades having polycrystalline diamond compact cutters attached thereto at selected positions along each of said blades, an outermost surface of each of said reaming blades extending at most to a radially least extensive one with respect to a longitudinal axis of said bit of a pass through circle and a drill circle, said drill circle substantially coaxial with said longitudinal axis, said pass-through circle axially offset from said drill circle and defining an arcuate section wherein said pass-through circle extends from said longitudinal axis past a radius of said drill circle, so that radially outermost cutters disposed on ones of said reaming blades disposed within said arcuate section drill a hole having a drill diameter substantially twice a maximum lateral extension of said reaming blades from said longitudinal axis while substantially avoiding wall contact along an opening having a diameter of said pass through circle.

45. The bi-center bit as defined in claim 44 wherein selected azimuthally corresponding ones of said pilot blades and said reaming blades are formed into unitized spiral structures.

46. The bi-center bit as defined in claim 44 wherein said selected positions for said cutters are selected so that lateral forces exerted by said inserts disposed on said pilot blades and said reaming blades are balanced as a single structure.

47. A The bi-center bit as defined in claim 46 wherein said lateral forces are balanced to less than about 10 percent of a total axial force exerted on said bit.

48. The bi-center bit as defined in claim 46 wherein said lateral forces are balanced to less than about 5 percent of a total axial force exerted on said bit.

49. The bi-center bit as defined in claim 44 wherein said pilot blades form part of a pilot section having a length along said longitudinal axis of said bit less than about 80 percent of a diameter of said pilot section.

50. The bi-center bit as defined in claim 49 wherein a total make-up length along said longitudinal axis of said pilot section and a reaming section formed from said reaming blades is less than about 133 percent of a drilling diameter of said bit.

51. The bi-center bit as defined in claim 44 wherein a center of mass of said bit is located within a distance of about 2.5 percent of a drill diameter of said bit from an axis of rotation of said bit.

52. The bi-center bit as defined in claim 44 wherein a center of mass of said bit is located within a distance of about 1.5 percent of a drill diameter of said bit from an axis of rotation of said bit.

53. The bi-center bit as defined in claim 44 wherein at least one jet disposed proximate to said reaming blades is oriented so that its axis subtends an angle of within approximately 30 degrees of a line normal to a longitudinal axis of said bit.

54. The bi-center bit as defined in claim 44 wherein at least one jet disposed proximate to said reaming blades is oriented so that its axis subtends an angle of within approximately 20 degrees of a line normal to a longitudinal axis of said bit.

55. A bi-center drill bit comprising:

a body having pilot blades and reaming blades affixed thereto at azimuthally spaced apart locations, said pilot blades and said reaming blades having polycrystalline diamond compact cutters attached thereto at selected positions along each of said blades, a center of mass of said bit located within a distance of about 2.5 percent of a drill diameter of said bit from an axis of rotation of said bit.

56. The bi-center bit as defined in claim 55 wherein said center of mass of said bit located within a distance of about 1.5 percent of a drill diameter of said bit from an axis of rotation of said bit.

57. The bi-center bit as defined in claim 55 wherein at least one jet disposed proximate to said reaming section and oriented so that its axis subtends an angle of within approximately 30 degrees of a line normal to a longitudinal axis of said bit.

58. The bi-center bit as defined in claim 55 wherein at least one jet disposed a proximate to said reaming section and oriented so that its axis subtends an angle of within approximately 20 degrees of a line normal to a longitudinal axis of said bit.

59. The bi-center bit as defined in claim 55 wherein selected azimuthally corresponding ones of said pilot blades and said reaming blades are formed into unitized spiral structures.

60. The bi-center bit as defined in claim 55 wherein said selected positions for said cutters are selected so that lateral forces exerted by said inserts disposed on said pilot blades and said reaming blades are balanced as a single structure.

61. The bi-center bit as defined in claim 60 wherein said lateral forces are balanced to less than about 10 percent of a total axial force exerted on said bit.

62. The bi-center bit as defined in claim 60 wherein said lateral forces are balanced to less than about 5 percent of a total axial force exerted on said bit.

63. The bi-center bit as defined in claim 55 wherein said pilot blades form part of a pilot section having a length along a longitudinal axis of said bit less than about 80 percent of a diameter of said pilot section.

64. The bi-center bit as defined in claim 54 wherein an outermost surface of each of said reaming blades extends at most to a radially least extensive one with respect to a longitudinal axis of said bit of a pass-through circle and a drill circle, said drill circle substantially coaxial with said longitudinal axis, said pass-through circle axially offset from said longitudinal axis and defining an arcuate section wherein said pass-through circle extends therein from said longitudinal axis past a radius of said drill circle, so that radially outermost cutters disposed on ones of said reaming blades disposed within said arcuate section drill a hole having a drill diameter substantially twice a maximum lateral extension of said reaming blades from said longitudinal axis while substantially avoiding wall contact along an opening having a diameter of said pass through circle.

65. The bi-center bit as defined in claim 55 wherein an outermost surface of each of said reaming blades conforms to a radially least extensive one with respect to a longitudinal axis of said bit of a pass-through circle and a drill circle, said drill circle substantially coaxial with said longitudinal axis, said pass-through circle axially offset from said longitudinal axis and defining an arcuate section wherein said pass-through circle extends therein from said longitudinal axis past a radius of said drill circle, so that radially outermost cutters disposed on said reaming blades drill a hole having a drill diameter substantially twice a maximum lateral extension of said reaming blades from said longitudinal axis while substantially avoiding wall contact along an opening having a diameter of said pass through circle.

66. A bi-center drill bit comprising:

a body having pilot blades and reaming blades affixed thereto at azimuthally spaced apart locations, said pilot blades and said reaming blades having polycrystalline diamond compact cutters attached thereto at selected positions along each of said blades, said pilot blades having additional diamond volume per unit length of said pilot blade attached thereon at locations proximate to a pass-through axis of said bit.

67. The bi-center bit as defined in claim 66 wherein ones of said polycrystalline diamond compact cutters proximate to a circle defined by precessing a longitudinal axis of said bit about said pass through axis are mounted at a different back rake angle than ones of said cutters disposed distal from said circle.

68. The bi-center bit as defined in claim 66 wherein ones of said polycrystalline diamond compact cutters proximate to a circle defined by precessing a longitudinal axis of said bit about said pass through axis are mounted at a different side rake angle than ones of said cutters disposed distal from said circle.

69. The bi-center bit as defined in claim 66 wherein said additional diamond volume comprises a higher number of said polycrystalline diamond compact cutters per unit length of said pilot blades.

70. The bi-center bit as defined in claim 66 wherein said additional diamond volume comprises additional cutters mounted azimuthally spaced apart from said polycrystalline diamond compact cutters.

71. The bi-center bit as defined in claim 66 wherein said additional diamond volume comprises said polycrystalline diamond compact cutters having thicker diamond tables thereon.

72. The bi-center bit as defined in claim 66 wherein said additional diamond volume comprises diamond inserts mounted on said pilot blades proximal to said pass through axis.

73. A bi-center drill bit comprising:

a body having pilot blades and reaming blades affixed thereto at azimuthally spaced apart locations, said pilot blades and said reaming blades having polycrystalline diamond compact cutters attached thereto at selected positions along each of said blades, said pilot blades having reinforcements thereon at locations proximate to a circle defined by precessing a longitudinal axis of said bit about a pass-through axis of said bit.

74. The bi-center bit as defined in claim 73 wherein said reinforcements comprise tungsten carbide inserts mounted on said pilot blades proximate to said circle.

75. The bi-center bit as defined in claim 73 wherein said reinforcements comprise greater width of said pilot blades at said locations proximate to said circle.

76. The bi-center bit as defined in claim 73 wherein said reinforcements comprise retention pockets for ones of said cutters mounted in said locations proximate to said circle, said retention pockets having greater surface contact area than retention pockets located distal from said circle.

77. The bi-center bit as defined in claim 73 wherein said pilot blades form part of a pilot section having a length along a longitudinal axis of said bit less than about 80 percent of a diameter of said pilot section.

78. The bi-center drill bit as defined in claim 77 wherein a total make-up length along said longitudinal axis of said pilot section and a reaming section formed from said reaming blades is less than about 133 percent of a drilling diameter of said bit.

79. The bi-center bit as defined in claim 73 wherein selected azimuthally corresponding ones of said pilot blades and said reaming blades are formed into unitized spiral structures.

80. The bi-center bit as defined in claim 73 wherein said selected positions for said cutters are selected so that lateral forces exerted by said inserts disposed on said pilot blades and said reaming blades are balanced as a single structure.

81. The bi-center bit as defined in claim 80 wherein said lateral forces are balanced to less than about 10 percent of a total axial force exerted on said bit.

82. The bi-center bit as defined in claim 72 wherein a radially outermost surface of each of said reaming blades extends at most to a radially least extensive one, with respect to said longitudinal axis, of a pass-through circle and a drill circle, said drill circle substantially coaxial with said longitudinal axis, said pass-through circle axially offset from said drill circle and defining an arcuate section extending therein from said longitudinal axis past a radius of said drill circle, so that radially outermost cutters disposed on ones of said reaming blades disposed within said arcuate section drill a hole having a drill diameter substantially twice a maximum lateral extension of said reaming blades from said longitudinal axis while substantially avoiding wall contact along an opening having a diameter of said pass through circle.

83. The bi-center bit as defined in claim 73 wherein a radially outermost surface of each of said reaming blades extends at most to a radially least extensive one, with respect to said longitudinal axis, of a pass-through circle and a drill circle, said drill circle substantially coaxial with said longitudinal axis, said pass-through circle axially offset from said drill circle and defining an arcuate section extending therein from said longitudinal axis past a radius of said drill circle, so that radially outermost cutters disposed on said reaming blades drill a hole having a drill diameter substantially twice a maximum lateral extension of said reaming blades from said longitudinal axis while substantially avoiding wall contact along an opening having a diameter of said pass through circle.

84. The bi-center bit as defined in claim 73 wherein at least one jet disposed proximate to said reaming blades is oriented so that its axis subtends an angle of within approximately 30 degrees of a line normal to a longitudinal axis of said bit.

85. The bi-center bit as defined in claim 73 wherein at least one jet disposed proximate to said reaming blades is oriented so that its axis subtends an angle of within approximately 20 degrees of a line normal to a longitudinal axis of said bit.

86. The bi-center bit as defined in claim 73 wherein a center of mass of said bit is located within about 2.5 percent of a diameter of said bit from an axis of rotation of said bit.

87. The bi-center bit as defined in claim 73 wherein a center of mass of said bit is located within a distance of about 1.5 percent of a drill diameter of said bit from an axis of rotation of said bit.

88. A method for drilling out a casing, comprising:

rotating a bi-center drill bit within said casing, said bit comprising a body having pilot blades and reaming blades affixed thereto at azimuthally spaced apart locations, said pilot blades and said reaming blades having polycrystalline diamond compact cutters attached thereto at selected positions along each of said blades, an outermost surface of each of s aid reaming blades conforming to a radially least extensive one with respect to a longitudinal axis of said bit of a pass through circle and a drill circle, said drill circle substantially coaxial with said longitudinal axis, said pass-through circle axially offset from said drill circle and defining an arcuate section wherein said pass-through circle extends from said longitudinal axis past a radius of said drill circle, so that said bit is constrained to rotate substantially about an axis of said pass-through circle, and radially outermost cutters disposed on said reaming blades substantially avoid wall contact with said casing, and drilling through float equipment disposed in said casing into earth formations beyond said casing, enabling rotation of said bit about said longitudinal axis so that a hole is drilled in said formations having a drill diameter substantially twice a maximum lateral extension of said reaming blades from said longitudinal axis.

89. The method as defined in claim 88 wherein selected azimuthally corresponding ones of said pilot blades and said reaming blades are formed into unitized spiral structures.

90. The method as defined in claim 88 wherein said selected positions for said cutters are selected so that lateral forces exerted by said inserts disposed on said pilot blades and said reaming blades are balanced as a single structure.

91. The method as defined in claim 90 wherein said lateral forces are balanced to less than about 10 percent of a total axial force exerted on said bit.

92. The method as defined in claim 90 wherein said lateral forces are balanced to less than about 5 percent of a total axial force exerted on said bit.

93. The method as defined in claim 88 wherein said pilot blades form part of a pilot section having a length along said longitudinal axis of said bit less than about 80 percent of a diameter of said pilot section.

94. The method as defined in claim 93 wherein a total make-up length along said longitudinal axis of said pilot section and a reaming section formed from said reaming blades is less than about 133 percent of a drilling diameter of said bit.

95. The method as defined in claim 88 wherein a center of mass of said bit is located within a distance of about 2.5 percent of a drill diameter of said bit from an axis of rotation of said bit.

96. The method as defined in claim 88 wherein a center of mass of said bit is located within a distance of about 1.5 percent of a drill diameter of said bit from an axis of rotation of said bit.

97. The method as defined in claim 88 wherein at least one jet disposed proximate to said reaming blades is oriented so that its axis subtends an angle of within approximately 30 degrees of a line normal to a longitudinal axis of said bit.

98. The method as defined in claim 88 wherein at least one jet disposed proximate to said reaming blades is oriented so that its axis subtends an angle of within approximately 20 degrees of a line normal to a longitudinal axis of said bit.

99. The method as defined in claim 88 wherein said pilot blades have increased diamond density thereon at locations proximate to a circle defined by precessing a pass-through axis of said bit about said longitudinal axis of said bit.

100. The method as defined in claim 99 wherein proximate to said circle said pilot blades comprise a higher number of said polycrystalline diamond compact cutters per unit length of said blades.

101. The method as defined in claim 99 wherein proximate to said circle said pilot blades comprise additional cutters mounted azimuthally spaced apart from said polycrystalline compact cutters.

102. The method as defined in claim 99 wherein said polycrystalline diamond compact inserts comprise thicker diamond tables thereon.

103. A bi-center drill bit comprising:

a body having pilot blades and reaming blades affixed thereto at azimuthally spaced apart locations, said pilot blades and said reaming blades having cutting elements attached thereto at selected positions along each of said blades, said reaming blades distributed around a circumference of said body and formed to provide clearance between said cutting elements disposed thereon and an opening having a pass through diameter, said reaming blades formed to drill a hole having a drill diameter larger than said pass through diameter.

104. The bi-center bit as defined in claim 103 wherein an outermost surface of each of said reaming blades extends at most to a radially least extensive one, with respect to a longitudinal axis of said bit, of a circle having said pass through diameter and a circle having said drill diameter, said drill diameter circle substantially coaxial with said longitudinal axis, said pass-through diameter circle being axially offset from said drill circle and defining an arcuate section wherein said pass-through diameter circle extends from said longitudinal axis past a radius of said drill circle, so that radially outermost cutters disposed on said reaming blades disposed within said arcuate section drill a hole having said drill diameter while substantially avoiding wall contact along said opening having said pass through diameter.

105. The bi-center bit as defined in claim 104 wherein said cutting elements comprise polycrystalline diamond compact inserts.

106. The bi-center bit as defined in claim 103 wherein selected azimuthally corresponding ones of said pilot blades and said reaming blades are formed into unitized spiral structures.

107. The bi-center bit as defined in claim 103 wherein said selected positions for said cutters are selected so that lateral forces exerted by said inserts disposed on said pilot blades and said reaming blades are balanced as a single structure.

108. The bi-center bit as defined in claim 107 wherein said lateral forces are balanced to less than about 10 percent of a total axial force exerted on said bit.

109. The bi-center bit as defined in claim 107 wherein said lateral forces are balanced to less than about 5 percent of a total axial force exerted on said bit.

110. The bi-center bit as defined in claim 103 wherein said pilot blades form part of a pilot section having a length along said longitudinal axis of said bit less than about 80 percent of a diameter of said pilot section.

111. The bi-center bit as defined in claim 110 wherein a total make-up length along said longitudinal axis of said pilot section and a reaming section formed from said reaming blades is less than about 133 percent of a drilling diameter of said bit.

112. The bi-center bit as defined in claim 103 wherein a center of mass of said bit is located within about 2.5 percent of a diameter of said bit from an axis of rotation of said bit.

113. The bi-center bit as defined in claim 103 wherein a center of mass of said bit is located within about 1.5 percent of a diameter of said bit from an axis of rotation of said bit.

114. The bi-center bit as defined in claim 103 wherein at least one jet disposed proximate to said reaming blades is oriented so that its axis is within approximately 30 degrees of a line normal to a longitudinal axis of said bit.

115. The bi-center bit as defined in claim 103 wherein at least one jet disposed proximate to said reaming blades is oriented so that its axis is within approximately 20 degrees of a line normal to a longitudinal axis of said bit.

116. A method for drilling out a casing, comprising:

rotating a bi-center drill bit within said casing, said bit comprising a body having pilot blades and reaming blades affixed thereto at azimuthally spaced apart locations, said pilot blades and said reaming blades having cutting elements attached thereto at selected positions along each of said blades, said reaming blades distributed around a circumference of said body and formed to provide clearance between said cutting elements disposed thereon and an interior of said casing, said reaming blades formed to drill a hole having a drill diameter larger than an interior diameter of said casing; and drilling through float equipment disposed in said casing into earth formations beyond said casing, thereby enabling rotation of said bit about a longitudinal axis thereof so that a hole is drilled in said formations having said drill diameter.

117. The method as defined in claim 116 wherein an outermost surface of each of said reaming blades extends at most to a radially least extensive one, with respect to a longitudinal axis of said bit, of a circle having a pass through diameter and a circle having said drill diameter, said drill diameter circle substantially coaxial with said longitudinal axis, said pass-through diameter circle being axially offset from said drill circle and defining an arcuate section wherein said pass-through diameter circle extends from said longitudinal axis past a radius of said drill circle, so that radially outermost cutters disposed on said reaming blades disposed within said arcuate section drill a hole having said drill diameter while substantially contact with said interior of said casing.

118. The method as defined in claim 116 wherein said cutting elements comprise polycrystalline diamond compact inserts.

119. A bi-center drill bit comprising:

a body having pilot blades and reaming blades affixed thereto at azimuthally spaced apart locations, said pilot blades and said reaming blades having polycrystalline diamond compact cutters attached thereto at selected positions along each of said blades, said pilot blades forming part of a pilot section having a length along a longitudinal axis of said bit less than about 80 percent of a diameter of said pilot section, and wherein at least one azimuthally corresponding one of said pilot blades and said reaming blades is formed into a unitized blade structure.

* * * * *